US008246088B2

(12) United States Patent
Stechschulte

(10) Patent No.: US 8,246,088 B2
(45) Date of Patent: Aug. 21, 2012

(54) COVER FOR FULLY CONCEALED STRIKER

(75) Inventor: Matt Stechschulte, Hilliard, OH (US)

(73) Assignee: Honda Motor Co., Ltd., Tokyo (JP)

( * ) Notice: Subject to any disclaimer, the term of this patent is extended or adjusted under 35 U.S.C. 154(b) by 530 days.

(21) Appl. No.: 12/486,527

(22) Filed: Jun. 17, 2009

(65) Prior Publication Data

US 2010/0320778 A1 Dec. 23, 2010

(51) Int. Cl.
*E05B 15/02* (2006.01)

(52) U.S. Cl. ..... 292/341.14; 292/341.15; 292/341.16; 292/341.17; 292/340; 292/1

(58) Field of Classification Search ..... 292/30, 292/341.14–341.74, 340, 341.14–341.17, 292/DIG. 73, 341.11–341.12, 108, 100, 209–210, 292/DIG. 72, DIG. 23, DIG. 61, DIG. 56, 292/DIG. 216, DIG. 200, DIG. 14, DIG. 42, 292/DIG. 43, 1; 296/106, 146.8; 180/69.2
See application file for complete search history.

(56) References Cited

U.S. PATENT DOCUMENTS

| | | | | |
|---|---|---|---|---|
| 4,225,166 | A * | 9/1980 | Tanaka et al. | 292/341.17 |
| 4,869,537 | A | 9/1989 | Compeau et al. | |
| 6,042,160 | A * | 3/2000 | Hamada et al. | 292/216 |
| 7,213,881 | B2 | 5/2007 | Kim et al. | |
| 7,222,893 | B2 | 5/2007 | Miyake et al. | |
| 7,367,598 | B2 | 5/2008 | Arabia, Jr. et al. | |
| 7,445,258 | B2 | 11/2008 | Rice et al. | |
| 7,758,097 | B2 * | 7/2010 | Dilley et al. | 296/76 |

FOREIGN PATENT DOCUMENTS

| | | |
|---|---|---|
| JP | 2004044258 | 2/2004 |
| JP | 2007217908 | 8/2007 |

* cited by examiner

*Primary Examiner* — Kristina Fulton
(74) *Attorney, Agent, or Firm* — Plumsea Law Group

(57) ABSTRACT

A striker cover completely conceals a striker and includes a first cover portion and a second cover portion. The first cover portion pivots with respect to the striker, and the second cover portion pivots with respect to the first cover portion. A spring element biases the first cover portion to pivot away from the striker. The second cover portion may be biased by inertia or a spring element to pivot toward the striker.

20 Claims, 8 Drawing Sheets

COVER FOR FULLY CONCEALED STRIKER

BACKGROUND OF THE INVENTION

1. Field of the Invention

The present invention relates to a cover that fully conceals a striker for, e.g., a tailgate latch, a car door, or a removable car seat attachment. The cover includes a dual hinged striker cover portion and an associated hole cover that fully conceals the striker from the user.

2. Description of Related Art

Striker covers have been used to protect striker assemblies from water and other contaminants, and further to enhance the overall appearance of the striker assemblies to the user. Most of the known covers protect only the inner workings of the striker assemblies while offering no protection to the striker itself. Most striker covers have a "key hole" that allows the cover to rotate around the striker, but fails to fully hide the striker assembly from the user.

There are some striker cover mechanisms that cover the entire striker assembly, including the striker. Generally, these striker cover mechanisms include a pair of individual cover members that appear to move independently of one another, and (in general) the same downward direction when depressed by a locking member. Once moved, the individual cover members expose and flank a centrally located striker. An example of such a striker cover is disclosed in JP2004044258 and shown in FIGS. 8 and 9.

There is a need in the art for a striker cover that covers the entire striker assembly and that is simpler to manufacturer than the prior art disclosed above.

SUMMARY OF THE INVENTION

A first embodiment of the present invention concerns a striker cover for completely covering a striker. The striker cover may include a first cover portion attached to a first hinge configured to allow the first cover portion to pivot with respect to the striker. The first cover portion may be biased away from the striker by a first biasing device. Further, there may be a second cover portion attached to a second hinge configured to allow the second cover portion to pivot with respect to the first cover portion. The second cover portion may be biased toward the first cover portion by a second biasing device. The first cover portion may be configured to allow passage of a portion of the striker when pressure is applied to the first cover portion in opposition to the bias of the first biasing device. The second cover portion may be configured to pivot against the bias of the second biasing device when a portion of the striker passes through the first cover portion.

In the first embodiment of the invention, the first cover portion may comprise a stop to prevent the first cover portion from uncovering the striker due to the bias of the first biasing device.

Further, in the first embodiment of the invention, the second cover portion may be located on a first side of the first cover portion and the second hinge may be located on a second side of the first cover portion.

The second cover portion of the first embodiment of the invention may be configured such that contact between the striker and the second cover portion results in the second cover portion pivoting against the bias of the second biasing device.

In the first embodiment, the first cover portion may be configured such that pressure on the first cover portion from a locking member causes the first cover portion to pivot against the bias of the first biasing device.

The first biasing device and the second biasing device of the first embodiment may be configured to bias the first cover portion and the second cover portion, respectively, to pivot in the same rotational direction.

In a second embodiment of the invention, a striker cover completely covers a striker, and includes a first cover portion configured to allow passage of a portion of the striker, and a second cover portion configured to pivot with respect to the first cover portion when the second cover portion is in contact with the striker. The first cover portion may be attached to a first spring biased hinge that allows the first cover portion to pivot with respect to the striker. The second cover portion may be attached to a second spring biased hinge that allows the second cover portion to pivot with respect to the first cover portion.

In the second embodiment of the invention, the first cover portion may further include a stop to prevent the first cover portion from uncovering the striker due to the bias of the first spring biased hinge.

Also in the second embodiment of the invention, the second cover portion may be located on a first side of the first cover portion and the second spring biased hinge may be located on a second side of the first cover portion.

The second cover portion of the second embodiment of the invention may be configured so that contact between the striker and the second cover portion results in the second striker portion pivoting against the bias of the second spring biased hinge.

The first cover portion of the second embodiment of the invention is configured such that pressure on the first cover portion from a locking member causes the first cover portion to pivot against the bias of the first spring biased hinge.

The first spring biased hinge and the second spring biased hinge of the second configuration of the invention may be configured to bias the first cover portion and the second cover portion, respectively, to pivot in the same rotational direction.

The first cover portion of the second embodiment may be configured to allow passage of a portion of the striker.

The second cover portion may be configured with respect to the first cover portion such that the second spring biased hinge is biased against passage of a portion of the striker through the first cover portion.

In a third embodiment of the invention, a latching system includes a striker, a locking member, and a striker cover. The striker cover may include a first cover portion with a through passage, a first hinge configured to allow the first cover portion to pivot with respect to the striker, a first biasing device configured to bias the first cover portion away from the striker, a second cover portion, a second hinge configured to allow the second cover portion to pivot with respect to the first cover portion, and a second biasing device configured to bias the second cover portion toward the first cover portion such that the second cover portion covers the passage of the first cover portion.

The latching system of the third embodiment of the invention may further include a stop to limit movement of the first cover portion in the direction of the bias of the first biasing device.

The latching system of the third embodiment of the invention may have the locking device configured to approach the striker cover such that it pushes the first cover portion against the bias of the first biasing device.

The latching system of the third embodiment of the invention may also have the locking device configured to approach the striker cover such that it pushes the second cover portion against the bias of the second biasing device.

In the latching system of the third embodiment of the invention, the first biasing device and the second biasing device may be configured to bias the first cover portion and the second cover portion, respectively, in the same rotational direction.

In the latching system of the third embodiment of the invention, the second cover portion may be located on a first side of the first cover portion and the second hinge is located on a second side of the first cover portion.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION OF THE PREFERRED EMBODIMENTS

Figure 1:
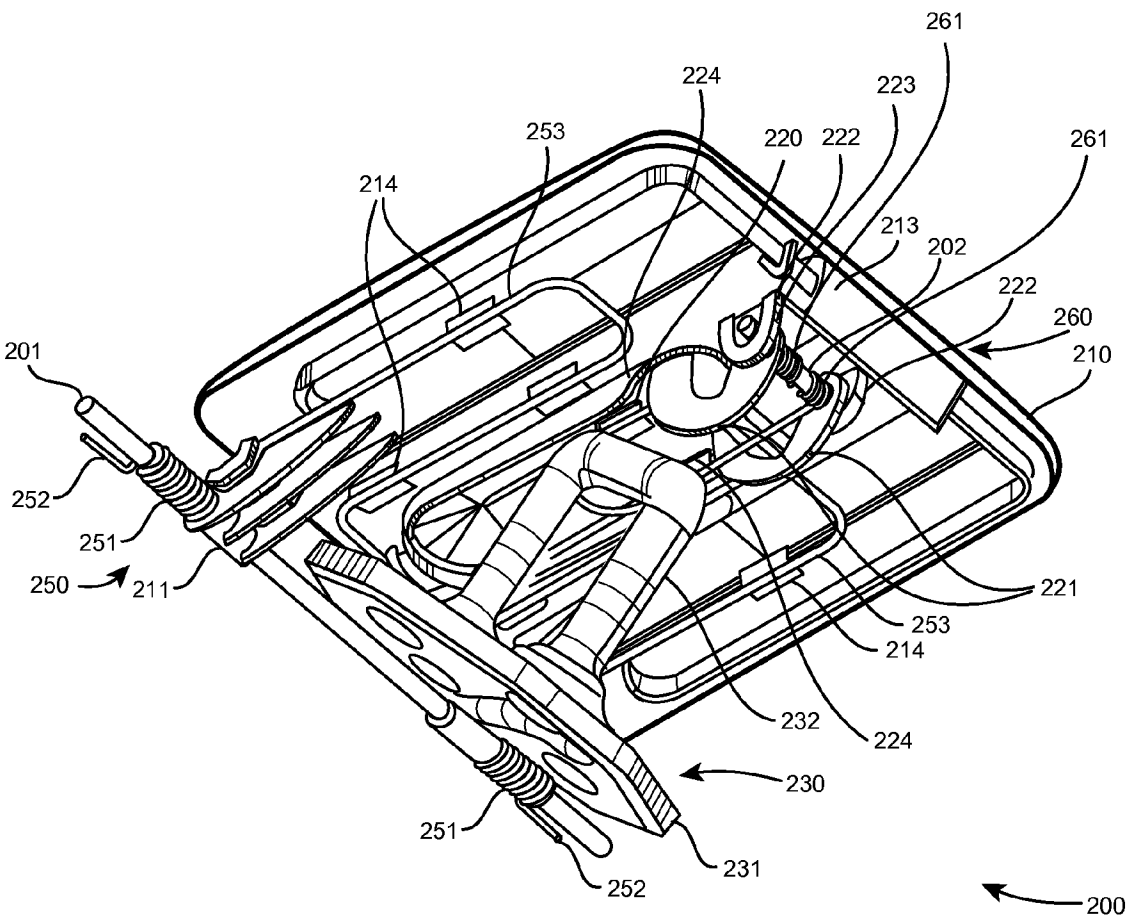
FIG. 1 is a perspective view of the underside of a striker cover according to the present invention in a non-engaged configuration.

FIGS. 1-7 illustrate views of a striker and striker cover, according to one embodiment of the invention. Preferably, one or more doors or the trunk of a motor vehicle include such an arrangement of striker and striker cover to present a sleek appearance rather than an exposed striker. While the following disclosure teaches an exemplary system and method for use with a door latch mechanism or tailgate latch, all of the principles, teachings, and concepts are also applicable, for example, to a striker for installing a seat or other device. Furthermore, the invention is not limited to use in a motor vehicle.

In describing directions associated with various components of the striker cover system, the term "top" refers to the side of an element facing away from the striker, while the term "underside" refers to the side of an element facing towards the striker.

In some embodiments, a latching system using the striker cover according to the present invention may be associated with the door jamb of an automobile. In other embodiments, a latching system using the striker cover according to the present invention may be associated with a trunk release. In still other embodiments, a latching system using the striker cover according to the present invention may be associated with a hatchback. In yet other embodiments, a latching system using the striker cover according to the present invention may be associated with a removable seat.

FIGS. 1-7 show a striker cover 200, which completely covers striker 230 when striker 230 is in an unengaged configuration (No locking element engaged with striker 230.). For purposes of illustration, only some components associated with striker cover 200 are shown in the current embodiment. Striker cover 200 comprises a first cover portion 210 that may be pivotably attached to first axle 201 by first hinges 211.

Striker 230 may comprise a base 231 and an engaging portion 232 shown roughly parallel to striker base 231. Engaging portion 232 as shown may be connected to the striker base 231 by vertical members 233.

While striker 230 is shown and described as having an engaging portion 232 parallel to striker base 231, the engaging portion may also be located on one of the vertical members 233. The location of the engaging portion may depend on the arrangement between the door, tailgate, or removable seat and striker 230.

Although striker 230 is shown with a simple U-shape for engaging portion 232 and vertical members 233, more elaborate shapes may be used. For example, the U-shape may be modified to be wider at the end with the engaging portion 232 than the end attached to the striker base 231. Such modifications may be made so that the engagement portion 232, the outside of a locking element 290, and striker cover 200 interact properly.

Striker 230 is preferably made of metal for ease of fabrication, but may be made of any other material capable of enduring the stresses associated with repeated engagement with a locking element 290. For example, striker 230 may be fabricated from carbon fibers or polymers to reduce weight.

Striker 230 is shown screwed or bolted to anchor portion 240 by striker anchoring elements 280. However, any suitable means of fastening known in the art may be used, including, but not limited to, welding, brazing, and riveting.

Figure 2:
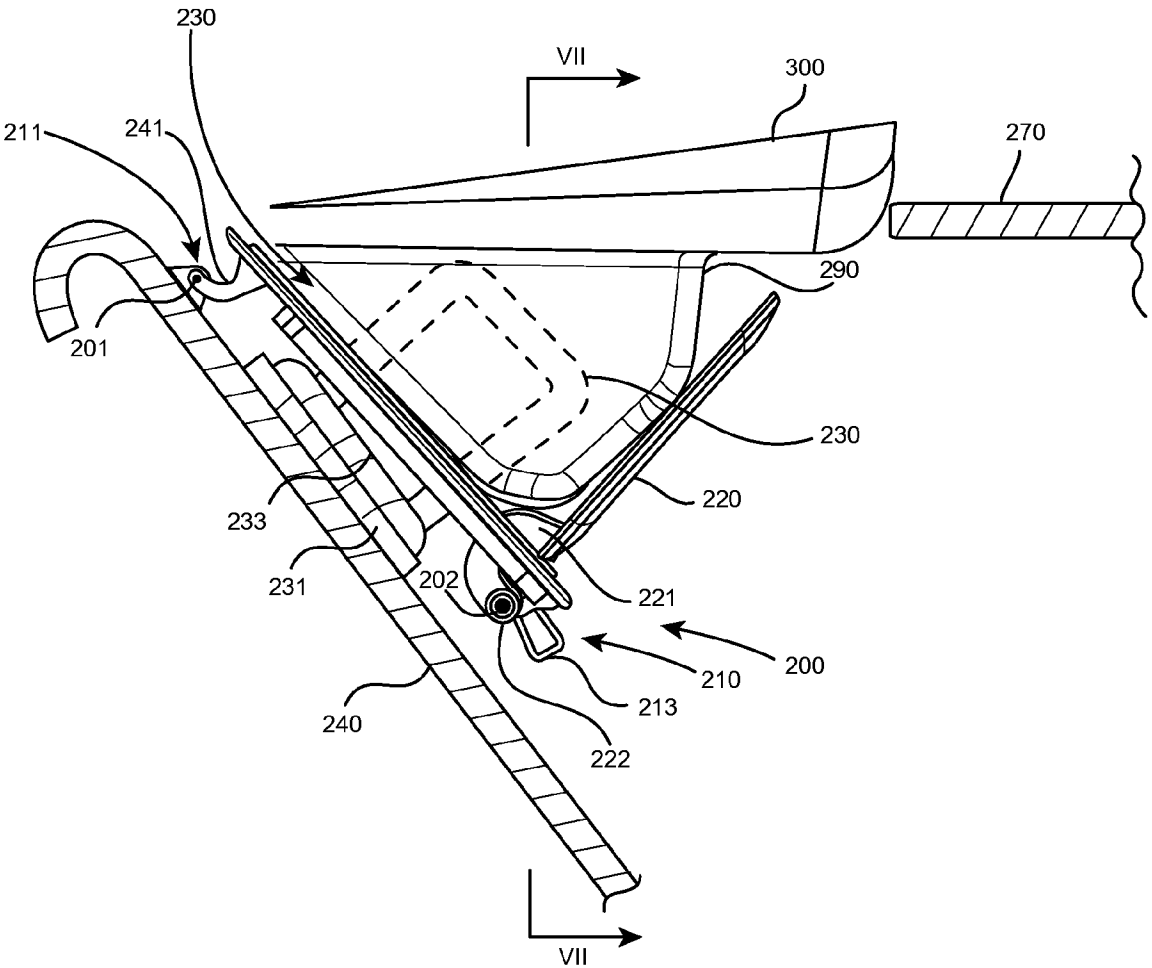
FIG. 2 is a side view of the striker cover of FIG. 1 with the striker in an engaged configuration with a locking device shown.
Figure 3:
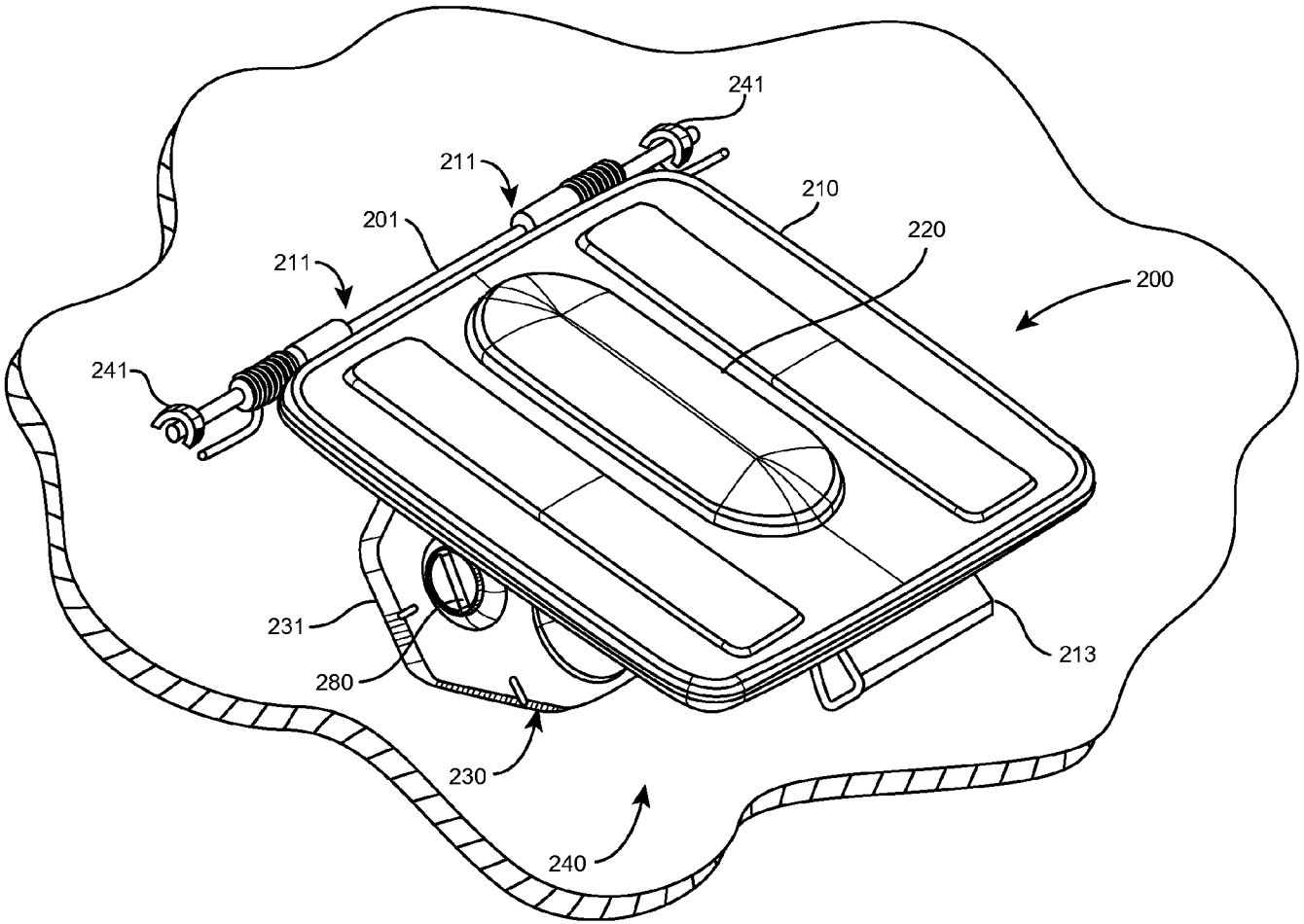
FIG. 3 is a top view of the striker cover of FIG. 1 with the striker in a non-engaged configuration.
Figure 4:
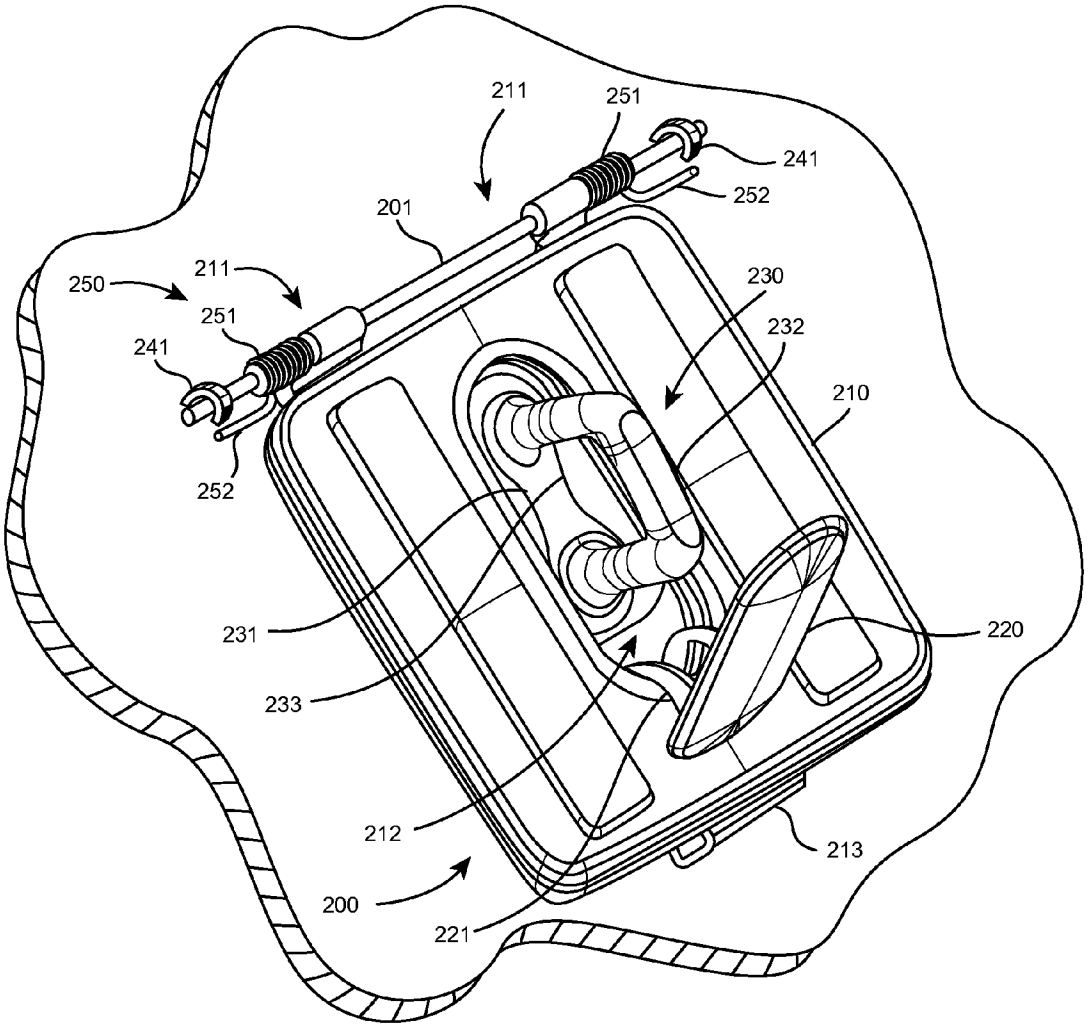
FIG. 4 is a perspective view of the striker cover of FIG. 1 in an engaged configuration with the locking device not shown for clarity.

While FIGS. 1, 2, and 4 show two vertical members, there may be only one vertical member 233 attaching engaging portion 232 to striker base 231. Striker base 231 may also not be required. As an alternative, one or two vertical members 233 may have external or internal threads. One or more holes may be placed through wall 270 to allow attachment of striker 230.

In the case of internal threads in one or more vertical members 233, a screw may penetrate the holes to engage the threads in the vertical members 233. In the case of external threads, a shoulder on one or more vertical members 233 larger than the hole through anchor portion 240 may provide a means of preventing the portion of the vertical member(s) above the threaded portion from going through anchor portion 240, with a locking nut or a regular nut with a lock washer screwed onto the threaded portion on the opposite side of anchor portion 240 from engaging portion 232.

As yet another alternative for mounting striker 230, vertical members 233 may end in a longer section of external threads than would be necessary to secure the striker to anchor portion 240. The longer threaded section may allow for nuts to be installed on the threaded section on both sides of anchor portion 240. This may allow the position of engaging portion 232 to be adjusted to ensure a better fit with a locking device. Such an arrangement may be facilitated by a configuration permitting access to the blind side of the threaded section to allow adjustment of the position of the nut(s) on the opposite side of anchor portion 240 from engaging portion 232. If there is no access to the blind side of the threaded section, shims may be used between striker base 231 and anchor portion 240 to maintain the engaging portion 233 in the appropriate position while adjusting only the nut(s) on the same side of anchor portion 240 as engaging portion 232.

In the case of striker 230 having no base 231, vertical member(s) 233 may also be attached to anchor portion 240 through welding, brazing, soldering, adhesives, or any other method known in the art. Anchor portion 240 may be reinforced in the area in which striker 230 is installed as an alternative to, or in addition to, having a striker base 231.

First cover portion 210 may be made of any material suitable to such an application including, but not limited to, metal, carbon fiber, and polymers. While polymers may be easier to shape by molding first cover portion 210 including features such as 211 hinges, any material used must be durable enough to withstand repeated impact by locking device 290.

First cover portion 210 may have a passage 212 through which a portion of striker 230 including engaging portion 232 can pass. Striker cover 200 may conceal striker 230 when in an unengaged configuration. Striker base 231 of striker 230 may be attached to anchor portion 240. Anchor portion 240 may have first axle retention elements 241 that keep first axle 201 in a fixed position relative to striker 230.

Depending on the material of the anchor portion 240, first axle retention elements 241 may be molded onto anchor portion 240, formed by stamping from a metal sheet forming anchor portion 240, or joined to anchor portion 240 by welding, brazing, adhesives, or any other method known in the art.

Second cover portion 220 may be pivotably attached to first cover portion 210 by arms 221 and second hinges 222. Second hinges 222 may be pivotably connected to second axle retention elements 223 through second axle 202. Second axle 202 may be secured to the underside of first cover portion 210 by second axle retention elements 223. Second cover portion 220 is preferably larger than passage 212 so that second cover portion 220 cannot rotate to a position on the opposite side of first cover portion 210.

Depending on the material of the first cover portion 210, second axle retention elements 223 may be molded onto first cover portion 210, formed by stamping from a metal sheet forming first cover portion 210, or joined to first cover portion 210 by welding, brazing, adhesives, or any other method known in the art.

First axle 201 may be made of metal, plastic, carbon fiber, composite, or any other suitable material. First axle 201 may be attached to first hinge 211 of first cover portion 210 by any method known in the art including, but not limited to, welding, pressure fit, brazing, soldering, adhesive, swaging, retaining ring, set screw, etc. Alternatively, first axle 201 and first hinge 211 may be made as a unit along with first cover portion 210.

Similarly to first axle 201, second axle 202 may be made of metal, plastic, carbon fiber, composite, or any other suitable material. Second axle 202 may be attached to second hinge 222 of second cover portion 220 by any method known in the art including, but not limited to, welding, pressure fit, brazing, soldering, adhesive, swaging, retaining ring, set screw, etc. Alternatively, second axle 202 and second hinge 222 may be made as a unit along with second cover portion 220.

First spring element 250 may surround first axle 201 and bias first cover portion 210 away from striker 230 and toward wall 270. First spring element 250 may have coil portions 251 on opposite sides of first hinges 211, with first spring end portions 252 bearing against each of first axle retention elements 241 on anchor portion 240.

First spring element lever portions 253 may be loops located on either side of passage 212 through first cover portion 210 as shown in FIG. 1. FIG. 1 shows first spring element lever portions 253 retained on the underside of first cover portion 210 by first spring element lever portion retainers 214. First spring element lever portion retainers 214 are shown in FIG. 1 as elements into which first spring lever portions 253 can snap, but first spring element lever portions 253 can be retained on the underside of first cover portion in any way known in the art. Moreover, first spring element lever portion retainers 214 may not be necessary because the spring bias of coil portions 251 may result in first spring element lever portions 253 bearing against the underside of first cover portion 210 regardless of the presence of first spring element lever portion retainers 214.

First spring element 250 may take a variety of arrangements as a coil spring. For example, there may be only one first spring element coil portion 251 with one first spring element end portion 252 and/or there may be only one loop in first spring element lever portion 253. One loop in first spring element lever portion 253 may straddle first cover portion passage 212, ending at such a point past passage 212 in an axial direction that it does not interfere with the operation of second hinges 222, or be on only one side of first cover portion passage 212. First spring element 250 may also be instead two spring elements rather than the single continuous spring element 250 shown in FIG. 1. It is not necessary that first spring element lever portion 253 be a loop, but it may end before forming a loop.

Second spring element 260 may surround second axle 202 and bias second cover portion 220 toward first cover portion 210. As with first spring element 250, second spring element 260 may have a variety of arrangements as a coil torsion spring. However, unlike first spring element 250, second spring element lever portion 263 of second spring element 260 may not rest against an underside of second cover portion 220 because the bias of second spring element lever 263 may be in a direction away from second cover portion 220. Thus, the underside of second cover portion 220 may have second spring element lever section retainers 224 to create a bias causing second cover portion 220 to close over passage 212. Second spring element lever section retainers 224 may be snap fit connections or any other means known in the art of attaching second spring element lever portion 263 to the underside of second cover portion 220. As with first spring element 250, second spring element lever portion 253 may be a loop, but a loop is not necessary. Depending on the orientation of striker cover 200, second cover portion 220 may preferably rely on gravity as a biasing force to close over passage 212.

Figure 7:
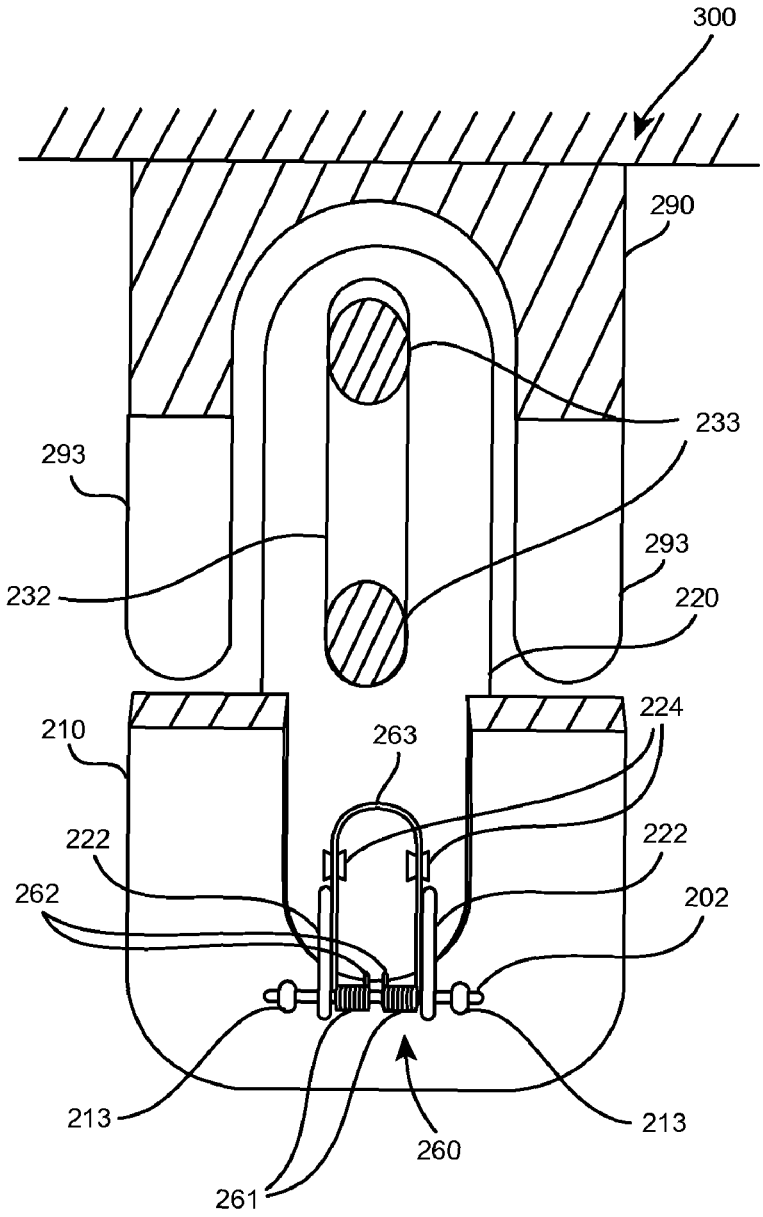
FIG. 7 is a section of FIG. 2 cut through section VII.
Figure 8:
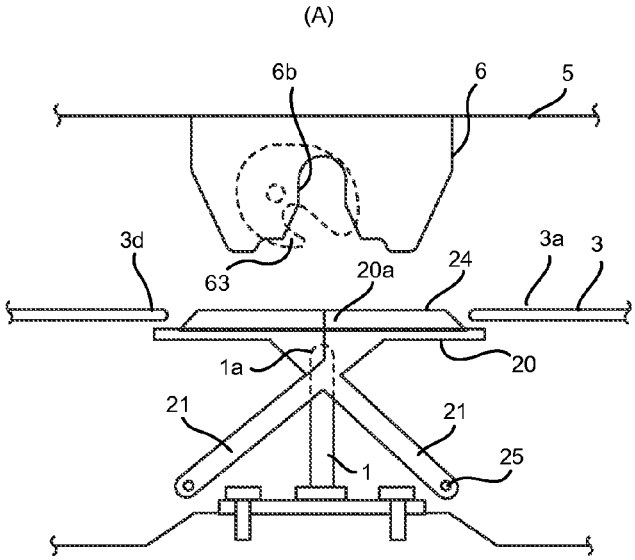
FIG.8 (PRIOR ART)
FIG. 8 illustrates a prior art cover for a fully concealed striker in a closed position.
Figure 9:
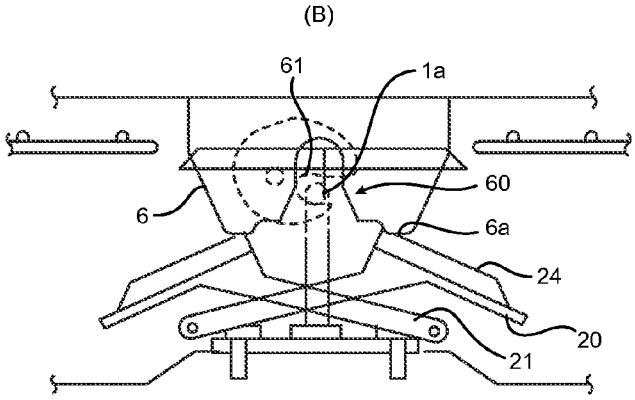
FIG.9 (PRIOR ART)
FIG. 9 illustrates the prior art cover of FIG. 8 in an open position.

Similarly to second spring element lever portion 263, second spring element end portions 262 may be secured to the underside of the first cover portion 220 as shown in FIG. 7. This may be accomplished in the same ways as second spring element lever portion 263 may be attached to the underside of second cover portion 220.

First cover portion 210 may have first cover stop 213 to prevent the bias of first spring element 250 from causing first cover 210 to rotate past wall 270 in a direction away from striker 230. When striker 230 is in an unengaged configuration, the bias of first spring element 250 may keep first cover portion 210 in a position approximately flush with wall 270. In an unengaged configuration, in a preferred embodiment, inertia will bias second cover portion 220 closed without the need for a spring 260, shown in FIG. 3. In an alternative embodiment, the bias of second spring elements 260 may keep second cover portion 220 closed over passage 212.

First cover stop 213 may be made as a unit with first cover portion 210 or it may be attached to first cover portion 210 by any means known in the art.

First hinge 211 is preferably located on the same side of first cover 210 as anchor portion 240 so that it will not protrude to the side of striker cover 200 facing a locking device. This may present a neater, more flush appearance. Similarly, arms 221 may extend from an underside of second cover portion 220 to the side of first cover portion 210 opposite the side of first cover portion 210 on which second cover portion 220 comes to rest.

Figure 5:
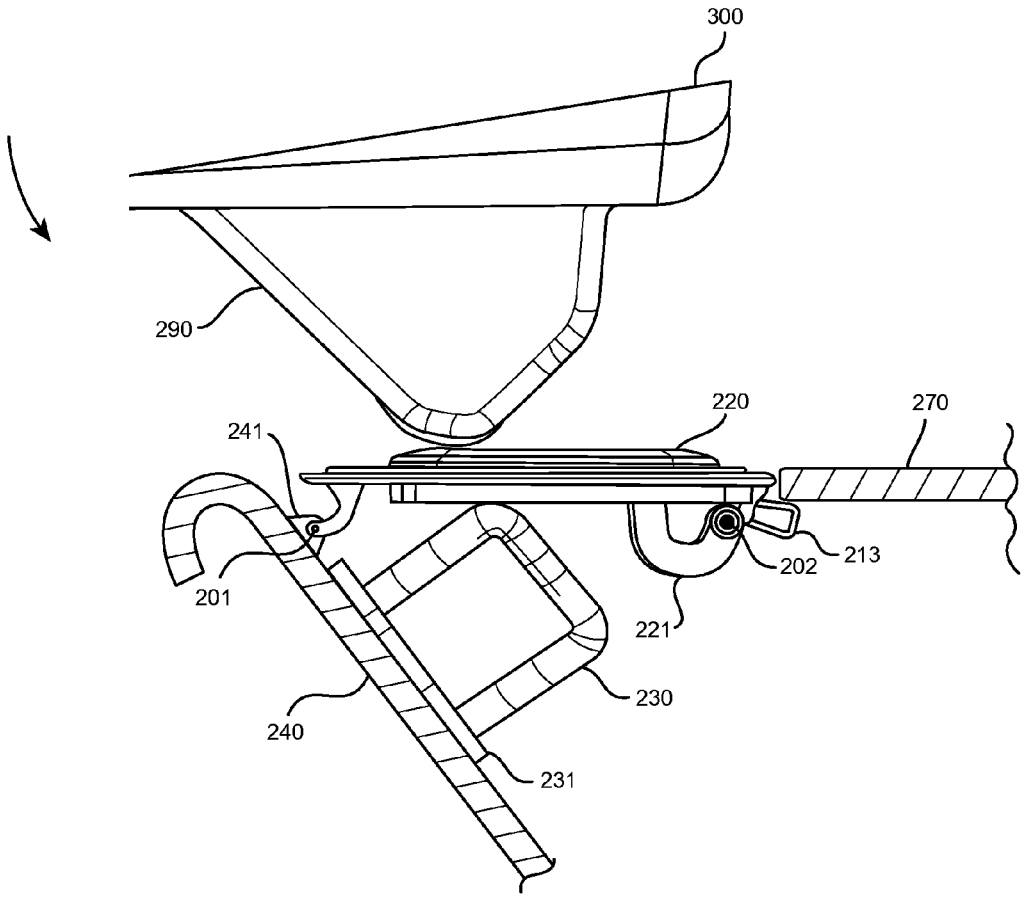
FIG. 5 is a side view of the striker cover of FIG. 1 at a point at which a locking device is coming into contact with the striker cover.

While FIG. 5 shows second cover portion 220 resting on top of first cover 210, first cover portion 210 may have a recessed area into which second cover portion 220 closely fits. This may create a flat even surface on the side of the striker cover 200 opposite striker 230 when second cover portion 220 is completely closed.

While the first hinges 211 and second hinges 222 are shown as having axles, other types of hinges may be used. For example, a thin flexible hinge made from plastic that joins two rigid plastic parts together, allowing them to bend along the line of the hinge (Known as a "living hinge), may be used instead. In fact, any known method known in the art of providing a pivoted connection may be used.

While first spring element 250 and second spring element 260 are shown as coiled torsion springs, they can be any type of spring known in the art. For example, one or both of first spring element 250 and second spring element 260 may be leaf springs.

Figure 6:
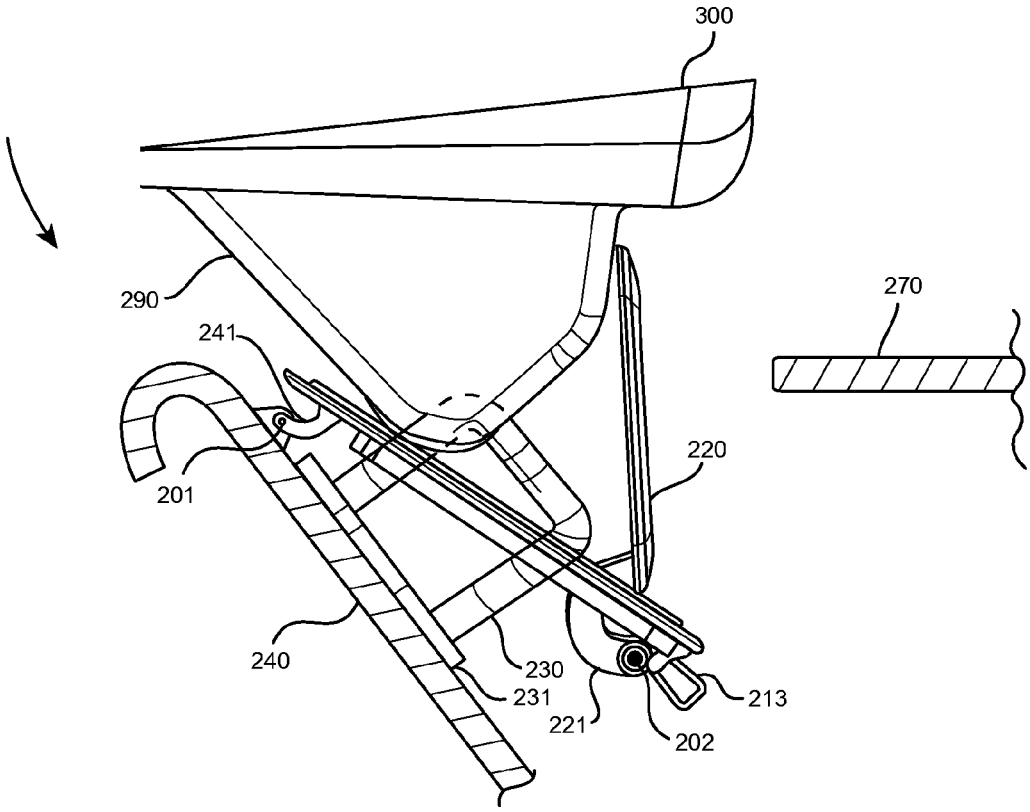
FIG. 6 is a side view of the striker cover of FIG. 1 at a point at which a locking device has depressed a first cover portion of the striker cover.

Operation of the present invention is shown in FIGS. 5 and 6. As tailgate 300 is lowered (The term "lowered" is used because of the orientation of the drawings. The tailgate, door, etc. may be oriented in a variety of ways such that it may pivot in a vertical or horizontal plane in either direction), locking element 290 makes contact with first cover portion 210. As shown in FIG. 7, which is a cross-section of FIG. 2, dimension A between locking element legs 293 of locking element 290 is great enough to provide clearance for second cover portion 220 such that the only contact between locking element 290 and first cover portion 210 is the locking element legs 293 contacting first cover portion 210 on either side of passage 212 and second cover portion 220.

As tailgate 300 is lowered farther, locking element 290 pushes first cover portion 210 such that it pivots toward anchor portion 240 against the bias of first spring element 250. Simultaneously, passage 212 of first cover portion 210 allows engaging portion 232 of striker 230 to pass through first cover portion 210.

As engaging portion 232 of striker 230 passes through first cover portion, striker 230 contacts the underside of second cover portion 220. This contact results in second cover portion 220 pivoting against the bias of second spring element 260 (or inertia in those embodiments without a second spring element 260) in a direction away from first cover portion 220 such that passage 212 is uncovered.

As tailgate 300 continues to be lowered, locking element legs 293 pass on either side of second cover portion 220. At some point, locking element second contact point 292 of locking element 290 comes into contact with the underside of second cover portion 220. The continued downward motion of locking element second contact point 292 pushes second cover potion 220 farther against the bias of second spring element 260.

FIG. 2 shows tailgate 300 completely lowered, with locking element 290 engaging striker 230. Locking element 290 may be any type of latching/locking element known in the art for engagement with strikers in a configuration similar to striker 230 of the present invention.

While FIGS. 5 and 6 show locking element 290 coming into contact with the lower side of second cover portion 220, locking element 290 and second cover portion 220 may be configured such that an edge of second cover portion 220 distal from second hinges 222 makes contact with locking element 290 as tailgate 300 is lowered. In that case, the distal edge of second cover portion may be beveled or curved to facilitate movement of locking element 290 against that edge.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

I claim:

1. A striker cover for covering a striker, comprising:

a first cover portion attached to a first hinge around which the first cover portion pivots with respect to the striker;

a first biasing device that applies a bias to the first cover portion in a direction pivoting the first cover portion away from the striker; and a second cover portion pivotably attached to the first cover portion by a second hinge around which the second cover portion pivots with respect to the first cover portion, wherein the first cover portion has a passage through which a portion of the striker may pass when pressure is applied to the first cover portion in a direction pivoting the first cover portion toward the striker and in opposition to the bias of the first biasing device, wherein the second cover portion is aligned with the passage such that the second cover portion covers at least a portion of the passage in a first closed position and pivots to a second open position to uncover the passage, and wherein the second cover portion pivots toward the second open position when a portion of the striker passes through the first cover portion.

2. The striker cover of claim 1, wherein the first cover portion comprises a stop for limiting pivoting of the first cover portion in the direction away from the striker so as to prevent the first cover portion from uncovering the striker.

3. The striker cover of claim 1, wherein the second cover portion is located on a first side of the first cover portion and the second hinge is located on a second side of the first cover portion opposite to the first side.

4. The striker cover of claim 1, further comprising a second biasing device that applies a second bias acting in a direction pivoting the second cover portion toward the first closed position, and wherein the second cover portion is configured such that contact between the striker and the second cover portion results in the second cover portion pivoting toward the second open position and against the second bias of the second biasing device.

5. The striker cover of claim 1, wherein the first cover portion is configured such that pressure on the first cover portion from a locking member causes the first cover portion to pivot against the bias of the first biasing device.

6. The striker cover of claim 4, wherein the first biasing device and the second biasing device are configured to bias the first cover portion and the second cover portion, respectively, to pivot in the same rotational direction.

7. A striker cover for covering a striker, comprising:

a first cover portion defining a passage through which a portion of the striker may pass; and a second cover portion pivotably attached to the first cover portion and aligned with the passage such that the second cover portion is disposed over the passage in a first closed position and pivots to a second open position to uncover the passage, and wherein the second cover portion is configured to pivot with respect to the first cover portion when the second cover portion is in contact with the striker, wherein the first cover portion is attached to a first hinge that allows the first cover portion to pivot with respect to the striker, wherein the second cover portion is pivotably attached to the first cover portion by a second hinge that allows the second cover portion to pivot with respect to the first cover portion, and wherein the first cover portion is subject to a biasing force acting in a direction pivoting the first cover portion away from the striker.

8. The striker cover of claim 7, wherein the first cover portion further includes a stop for limiting pivoting of the first cover portion in the direction away from the striker so as to prevent the first cover portion from uncovering the striker.

9. The striker cover of claim 7, wherein the second cover portion is located on a first side of the first cover portion and the second hinge is located on a second side of the first cover portion opposite to the first side.

10. The striker cover of claim 7, wherein the second cover portion is configured so that contact between the striker and the second cover portion results in the second striker portion pivoting toward the second open position and against a biasing force acting in a direction pivoting the second cover portion toward the first closed position.

11. The striker cover of claim 7, wherein the first cover portion is configured such that pressure on the first cover portion from a locking member causes the first cover portion to pivot against the biasing force acting in a direction pivoting the first cover portion away from the striker.

12. The striker cover of claim 7, wherein the first cover portion and the second cover portion are biased to pivot in the same rotational direction.

13. The striker cover of claim 7, wherein the passage is defined at an interior location of the first cover portion such that the passage is fully enclosed by the first cover portion.

14. The striker cover of claim 7, wherein the second cover portion is configured with respect to the first cover portion such that the second cover portion is biased in a direction toward the first closed position and against passage of a portion of the striker through the first cover portion.

15. A latching system, comprising:

a striker;

a locking member; and a striker cover comprising:

a first cover portion comprising a passage therethrough;

a first hinge around which the first cover portion pivots with respect to the striker;

a first biasing device that applies a bias to the first cover portion in a direction pivoting the first cover portion away from the striker;

a second cover portion; and a second hinge that pivotably attaches the second cover portion to the first cover portion and allows the second cover portion to pivot with respect to the first cover portion between a first closed position covering at least a portion of the passage and a second closed position uncovering the passage.

16. The latching system of claim 15, further comprising a stop to limit pivoting of the first cover portion in the direction away from the striker.

17. The latching system of claim 15, wherein the locking member is configured to approach the striker cover such that it the locking member pushes the first cover portion in a direction pivoting toward the striker and against the bias of the first biasing device.

18. The latching system of claim 15, further comprising a second biasing device that applies a second bias to the second cover portion in a direction pivoting the second cover portion toward the first closed position, wherein the locking member is configured to approach the striker cover such that the locking member pushes the second cover portion toward the second open position and against the second bias of the second biasing device.

19. The latching system of claim 15, wherein the first cover portion and the second cover portion are biased in the same rotational direction.

20. The latching system of claim 15, wherein the second cover portion is located on a first side of the first cover portion and the second hinge is located on a second side of the first cover portion opposite to the first side.

* * * * *